US005662060A

United States Patent [19]

Lemke

[11] Patent Number: 5,662,060

[45] Date of Patent: Sep. 2, 1997

[54] WATER CRAFT AND STANDOFF ASSEMBLIES THEREFOR

[76] Inventor: Stuart H. Lemke, 349 River Bluff Rd., Mosinee, Wis. 54455

[21] Appl. No.: 524,636

[22] Filed: Sep. 7, 1995

[51] Int. Cl.[6] ..... B63B 59/02

[52] U.S. Cl. ..... 114/219; 114/343; 114/270

[58] Field of Search ..... 114/270, 219, 114/230, 343, 361, 362, 364

[56] References Cited

U.S. PATENT DOCUMENTS

| | | | |
|---|---|---|---|
| 3,077,175 | 2/1963 | Johnson | 114/215 |
| 3,106,931 | 10/1963 | Cooper | 114/361 |
| 3,693,573 | 9/1972 | Murphy | 114/219 |
| 4,074,379 | 2/1978 | Grossman et al. | 9/1.6 |
| 4,309,956 | 1/1982 | Yamaguchi | 114/249 |
| 4,738,215 | 4/1988 | McMahon | 114/219 |
| 4,823,724 | 4/1989 | Lumpkin | 114/343 |
| 4,883,013 | 11/1989 | Lin | 114/219 |
| 4,909,176 | 3/1990 | Kobayashi | 114/270 |
| 5,113,702 | 5/1992 | Capps | 114/219 |

FOREIGN PATENT DOCUMENTS

| | | | |
|---|---|---|---|
| 689884 | of 1979 | U.S.S.R. . | |
| 1689202 | 11/1991 | U.S.S.R. | 114/230 |

*Primary Examiner*—Edwin L. Swinehart

*Attorney, Agent, or Firm*—Thomas D. Wilhelm; Brian R. Tumm

[57] ABSTRACT

This invention pertains to novel water craft, having novel standoff assemblies. The standoff assemblies prevent the water craft from being driven with destructive force into a dock or other relatively immobile object above the outer edges of the water craft. The standoff assemblies of the invention extend upwardly from the outer edge of the water craft. Adjustably extensible support members mount the standoff assembly to the water craft at typically three mounting loci. The mounting loci are typically spaced both vertically and laterally from each other.

76 Claims, 5 Drawing Sheets

WATER CRAFT AND STANDOFF ASSEMBLIES THEREFOR

FIELD OF THE INVENTION

This invention relates to water craft, and especially to personal water craft, typically water-jet powered, and of relatively recent development. Of particular interest, this invention relates to protecting such water craft from being damaged by being thrown into docks or like relatively immobile objects which the water craft may be impacted against when e.g. left unattended in the water.

BACKGROUND OF THE INVENTION

It is generally known to protect boats and other water craft from impacts with relatively immobile objects. Pleasure boats are typically outfitted with bumpers or the like, hanging down from the gunwale of the boat, to serve as an interface with a dock or like relatively immobile object. U.S. Pat. No. 4,823,724 Lumpkin teaches a typical such bumper at 13, in use (FIG. 4), and being stored in a receptacle at the gunwale 7 of the boat (FIGS. 1 and 3).

It is also known to mount bumpers to a water craft using several spaced mounting loci on the deck of the water craft as in U.S. Pat. No. 4,309,956 Yamaguchi.

Such bumpers are, however, ineffective for use along the gunwale of personal water craft because the gunwale is so close to the water line as to be below the typical dock. Thus, the bumpers would hang only below the dock, and would not interface with the dock. If such bumpers were, on the other hand, mounted to the inwardly-disposed main body of the personal water craft, they would still be generally too low in the water to interface with the dock. Further, they would be inboard of the outer edges of the water craft, and would thus not protect the outer edges of the water craft. In addition, typically available such bumpers are extraordinarily large compared to the small size of personal water craft, and would thus be too cumbersome for routine carriage and use with such small, but valuable, water craft.

Rather, what is needed is a small compact, light-weight standoff assembly which is easily mounted to the water craft to so protect it, and easily dismounted from the personal water craft, and which is small enough to be carried and stored on the craft, for use at diverse locations on the water.

It is an object of this invention to provide an upstanding standoff assembly, for attachment to a water craft.

It is another object to provide an upstanding standoff assembly having a base support member for securement at e.g. the gunwale of the water craft, a base member extension for extending upwardly from the base member to serve as an interface between the water craft and a dock, and upper support members for laterally bracing the standoff assembly against the main body of the water craft.

It is still another object to provide a standoff assembly which can be adjusted to fit on a wide variety of models of water craft, especially water craft having relatively lower gunwales near the water line, and a relatively higher, inwardly-disposed, main body.

It is yet another object to provide a standoff assembly which can be extended in use, and retracted to compact size for storage on a personal water craft when not in use.

SUMMARY OF THE DISCLOSURE

Some of the objects are obtained in a first family of embodiments comprehending a standoff assembly, for attachment to a water craft, the standoff assembly comprising a first base support member, having a lower end, for securement to the water craft at a first lower locus; an base member extension extending upwardly from the first base support member, for interfacing with an object which is relatively immobile, relative to the mobility of the water craft, above the first base support member; and a second upper support member secured to one of the base support member and the base member extension above the first lower locus, for extending laterally from the first base support member and interfacing with the water craft at a second locus above the lower locus.

Preferably, the second support member is mounted to one of the base support member and the base member extension, for pivotation with respect to the one of the base support member and the base member extension, thereby to pivot, as desired, into an orientation parallel to the base support member.

The base support member may comprise lock apparatus for locking the lower end of the base support member to the water craft at the lower locus, the lower end including a leg extending downwardly along the axis of the base member extension, for insertion into a receptacle in the water craft at the first lower locus, and for thereby being secured to the water craft at the first lower locus.

In preferred embodiments, the lower end of the base support member is secured at the first lower locus for rotation about the axis of the base member extension while the base member extension is in an upstanding orientation. Preferably, a locking stud extends transverse to the leg, for locking the leg, and respectively the first base support member, against vertical movement with respect to the water craft.

Preferably, the first base support member and the base member extension, the second support member, and where appropriate a third support member, each comprise respective first and second elongated elements, for extending the respective combinations of elements to first extended lengths for use, and for retracting the respective elements to second retracted lengths for storage, and a locking device, for locking the first and second elements relative to each other along respective ranges of lengths of the respective members.

The second, and optional third, support member may further include locking apparatus for locking the respective support member to the water craft at the respective locus, the locking apparatus preferably comprising a lock button, in combination with a receiving bracket for securement to the water craft, the receiving bracket, when secured to the water craft, being adapted to receive the lock button and thereby to lock the respective support member to the water craft, through the receiving bracket. The lock button is preferably mounted to the respective support member for restrained pivotation with respect to the respective support member.

Others of the objects are attained in other embodiments comprehending a standoff assembly, for attachment to a water craft, the standoff assembly comprising a first base support member as above; a base member extension as above; a second support member, secured to one of the base member extension and the first base support member, for securement to the water craft at a second locus at least as high as the first base support member; and a third support member, secured to one of the base member extension, the first base support member, and the second support member, the third support member being adapted for securement to the water craft at a third locus above the lower end of the first base support member, the combination of the first, second and third support members providing at least three points of support between the stand-off device and the water craft, with at least one of the at least three points of support being higher than at least one other of the at least three points of support.

Preferably, the second and third support members are mounted to at least one of the base member extension and the first base support member, for pivotation with respect to the first base support member, thereby to pivot into an orientation parallel to the first base support member, such as for storage.

In preferred embodiments, the second upper support member, when extended away from the first base support member thereby to interface with a water craft, defines, in combination with the first base support member, an imaginary plane, the third support member, when extended away from the one of the first base support member and the base member extension, thereby to interface with the water craft, defining an angle of at least about 30 degrees, preferably at least about 45 degrees, more preferably at least about 60 degrees, with respect to the imaginary plane.

It is preferred that each of the second and third support members have a length defined between a first end, secured to one of the base member extension and the first base support member, and a second distal end, for securement to the water craft, at least one, preferably both, of the second and third support members being mounted to extend the respective distal end laterally away from the first base support member to thereby be secured to the water craft at respective second and third loci, laterally displaced from the first lower locus, and preferably laterally displaced from each other.

In some embodiments, the first and second support members are secured to the water craft at respective first and second lower loci, the third support member being secured in the standoff assembly above the lower end of the first base support member, for securement to the water craft at a third locus above the lower end, the third locus being displaced both vertically and laterally from the lower end.

Others of the objects are attained in a standoff assembly, for attachment to a personal water craft which has opposing first and second gunwales on opposing first and second sides of the personal water craft, first and second foot rests disposed inwardly of, and below, the respective gunwales, and a centrally disposed main body between, and extending upwardly from, the foot rests. Given that environment, the standoff assembly comprises a generally U-shaped support member having (i) first and second spaced support legs, upstanding when the standoff assembly is mounted on the personal water craft, the first and second support legs having respective first and second lower ends, (ii) first and second lock devices at the first and second lower ends, for locking the standoff assembly to the personal water craft at a first locus at the first side, and at a second locus disposed inwardly of the water craft from the first side, (iii) a transverse connecting leg connecting the first and second upstanding support legs to each other, and (iv) a third lock device mounted in the standoff assembly above the first and second lock devices, for locking the standoff assembly to the personal water craft at the main body, preferably at an elevation above the first and second lock devices.

Still other objects are obtained in a family of embodiments comprehending a personal water craft, comprising a floatation body; drive apparatus mounted in the personal water craft; and a standoff assembly mounted in the personal water craft, the standoff assembly comprising a first base support member, having a lower end, secured to the personal water craft at a first lower locus, a base member extension extending upwardly from the first base support member, for interfacing with an object which is relatively immobile, relative to the mobility of the personal water craft, above the first base support member, and a second upper support member, secured to one of the first base support member and the base member extension above the lower end, for extending laterally from the first base support member and for being secured to the floatation body at a second locus above the lower end.

In a related family of embodiments, the invention comprehends a personal water craft wherein the standoff assembly incorporates a second support member, secured to one of the base member extension and the first base support member, for securement to the floatation body at a second locus at least as high as the lower end, and a third support member; secured to one of the base member extension, the first base support member, and the second support member, the third support member being adapted to be secured to the floatation body at a third locus above the lower end, the combination of the first, second and third support members providing at least three points of support between the stand-off device and the water craft, with at least one of the at least three points of support being higher than at least one other of the at least three points of support.

The third support member may be secured to the one of the base member extension and the base support member above the lower end, and interface with the floatation body at the third locus, above the lower end.

In some embodiments, the lower end of the base support member comprises a leg, and the floatation body comprises a receptacle, receiving the leg.

In preferred embodiments, the locking apparatus on the second, and optionally the third, support member comprises a lock button, and a receiving bracket secured to the floatation body, the receiving bracket being adapted to receive the lock button and thereby to lock the second support member to the floatation body, through the bracket, the locking apparatus being mounted to the respective second and third support members for restrained pivotation with respect to the respective second and third support members.

Preferably, the personal water craft includes a storage compartment adjacent the lower end of the first base support member, and in communication with the lower end to receive the standoff assembly within the storage compartment while the standoff assembly is secured to the floatation body at the lower end, the storage compartment preferably being comprised in the floatation body, with the standoff assembly being mounted for pivotation with respect to the water craft at the lower end, thereby to pivot into a substantially horizontal orientation for storage in the storage compartment, and to pivot into an upstanding orientation for standoff use, all while the standoff assembly is secured to the floatation body at the lower end.

Further objects of the invention are attained in a method of protecting a floating water craft, having a first degree of mobility in the water, from being damaged by wave action urging the water craft against a second object having a second lesser degree of mobility in the water, the second object having a first height above the water, the water craft having an outer edge as viewed from above, and opposing first and second sides. The method comprises the steps of positioning the water craft sufficiently close to the second object that the second object poses a hazard to the water craft; and extending a base member extension of a standoff assembly upwardly above the outer edge of the water craft to at least the first height, the standoff assembly being secured to the water craft at lower and upper vertically spaced loci of securement, the spaced securements fixing the orientation of the base member extension with respect to the water craft, the base member extension being effective to interface with the second object, and thereby to stand the water craft off from the second object and generally to prevent the water craft from being impacted against, and damaged by, the second object. At least one of the loci of securement is spaced laterally from the others of the loci of securement.

The method preferably includes employing two such standoff assemblies on a common side of the water craft.

Figure 1:
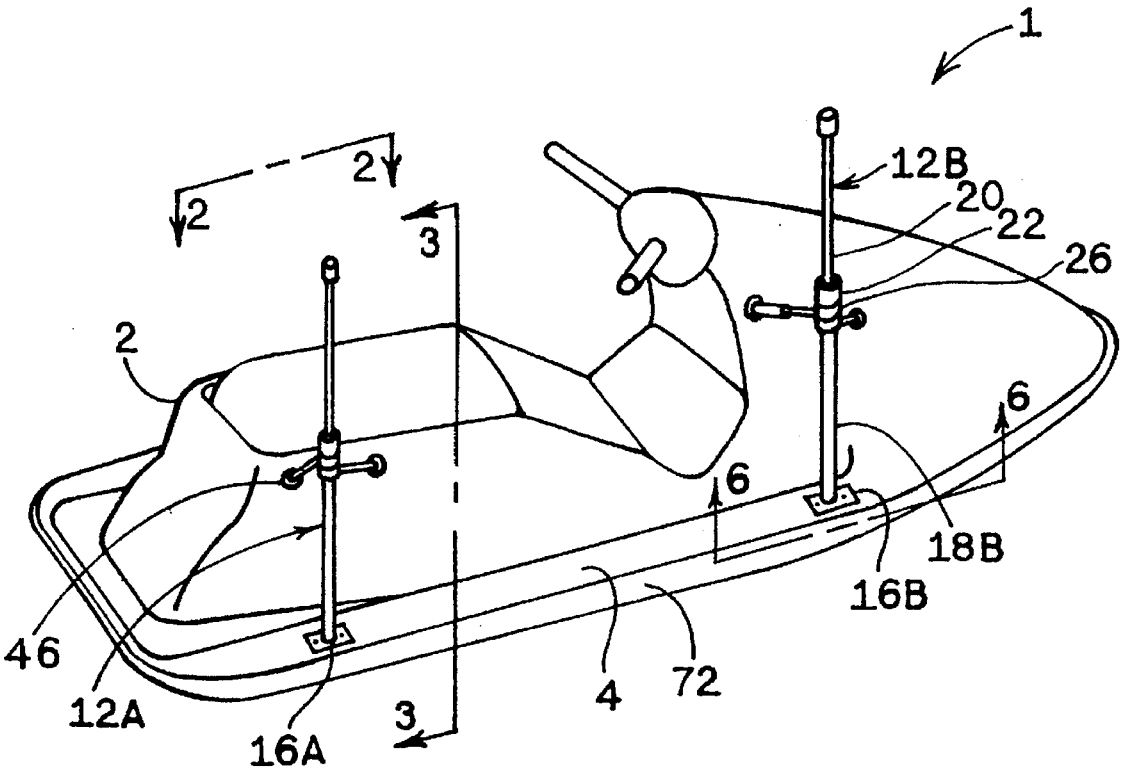
FIG. 1 shows a pictorial view of a personal water craft incorporating a pair of standoff assemblies of the invention.

The invention is not limited in its application to the details of construction and the arrangement of the components set forth in the following description or illustrated in the drawings. Rather, the invention is capable of other embodiments or of being practiced or carried out in various ways. Also, the terminology and phraseology employed therein is for purpose of description and illustration and should not be regarded as limiting. Like reference numerals are used to indicate like components.

DETAILED DESCRIPTION OF THE ILLUSTRATED EMBODIMENTS

Referring now by characters of reference to the drawings, FIG. 1 illustrates a personal water craft 1, having a floatation body, generally including a main body 2, left and right gunwales 4 on opposing sides of the main body, and first and second foot rests 6 between the main body and respective ones of the gunwales.

The term "floatation body" as used therein generally comprehends the more-or-less enclosed unitary body that defines the outer surfaces of a water craft, also known in the trade as the "hull."

Figure 4:
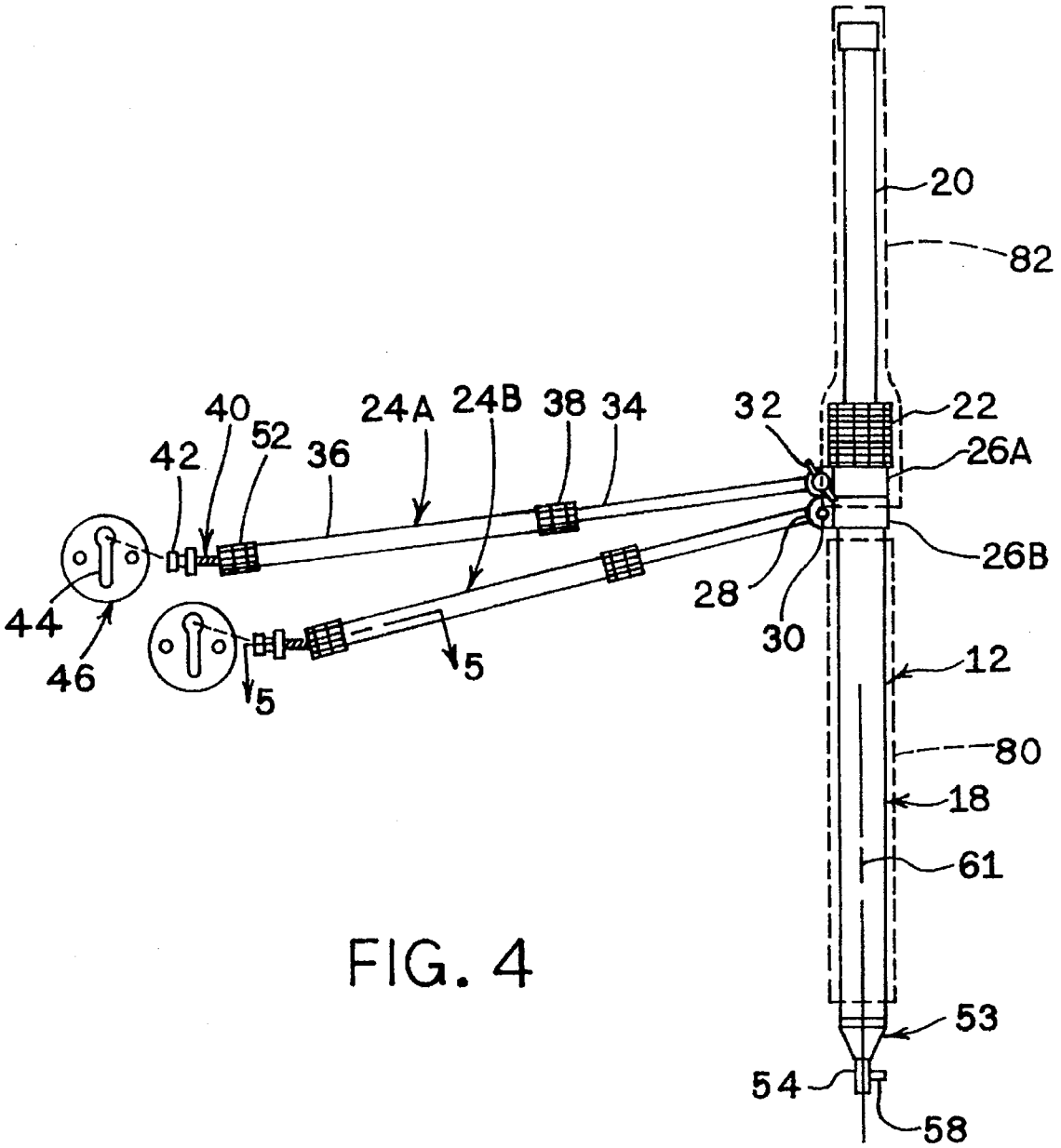
FIG. 4 shows an elevation view of a standoff assembly of the invention.

A drive engine 3 is typically housed in the main body 2. First and second standoff assemblies 12A, 12B respectively, of the invention, are mounted on the right gunwale. FIG. 4 illustrates relevant details of the standoff assembly 12. Returning to FIG. 1; each standoff assembly is secured to the gunwale 4, through receiving brackets 16A, 16B on the right side of the water craft 1. Corresponding receiving brackets 16A, 16B are preferably also mounted to the gunwale on the left side of the water craft for use, as desired, of standoff assemblies on the left side of the water craft.

Figure 8:
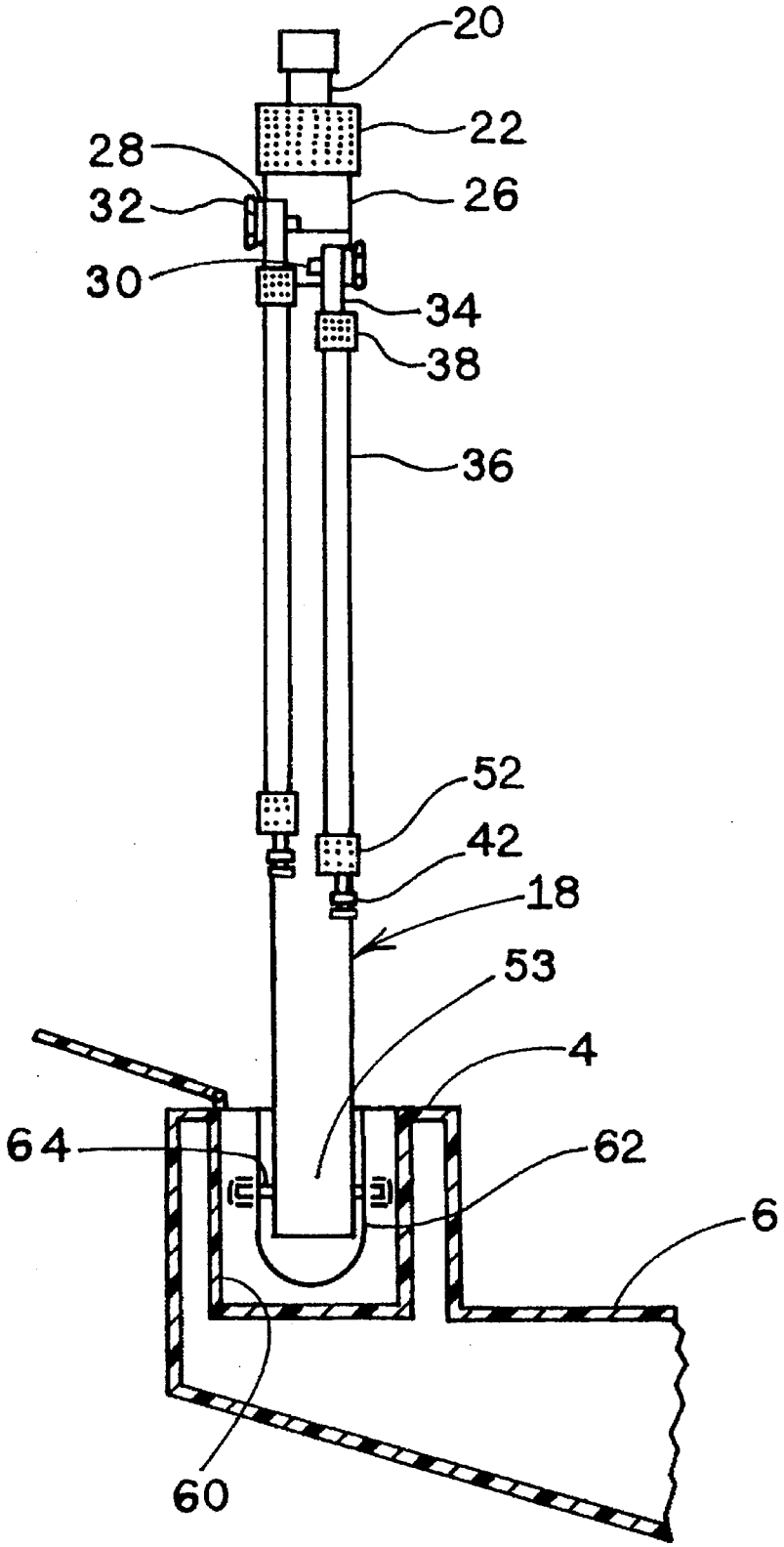
FIG. 8 is a cross-section of a portion of the floatation body, and corresponding storage compartment, and is taken at 8—8 of FIG. 7.

Referring now to FIG. 4, each standoff assembly 12 includes, as a base member 18, a first tube mounted to a respective receiving bracket 16, and as a base member extension 20, a second tube, received in the first tube of base member 18. The base member extension 20 is extensible and retractable within base member 18, in a substantially telescoping arrangement. Conventional lock nut 22 is secured by threads (not shown) to base member 18, and provides for locking the length of the combination of the base member and the base member extension at any length between and including a maximum length, with the base member extension fully extended (FIG.4 ), and a minimum length, with the base member extension fully retracted (FIG. 8). Base member 18 and base member extension 20 are made from e.g. metal or plastic tubing. Other materials are contemplated as possible.

Referring again to FIG. 4, first and second upper support arms 24A, 24B are mounted to base member 18 immediately below lock nut 22, by first and second plastic collars 26A, 26B. Each collar 26 includes a two-part flange 28 extending outwardly from base member 18. The respective support arm 24 is mounted for pivotation with respect to a lock stud 30, secured to the flange 28 by a cooperating lock nut 32. The support arm correspondingly also pivots generally with respect to the adjacent base member 18 and base member extension 20. By tightening the lock nut 32 with respect to the lock stud 30, the respective flange 28 is tightened with respect to base member 18. In addition, the respective upper support arm 24 is, at the same time locked, preventing pivotation of the support arm with respect to the collar 26, about lock stud 30. By loosening the lock nut 32 with respect to lock stud 30, the respective flange 28 is loosened with respect to base member 18; and the respective upper support arm 24 is unlocked, facilitating pivotation of the support arm 24 with respect to the lock stud 30.

Each collar 26 has a frictional relationship with base member 18. Thus, the effective friction between the base member 18 and the respective collar 26 can be increased or decreased by tightening or loosening the corresponding lock nut 32, and thus the corresponding collar 26. When the corresponding lock nut 32 is loosened, the respective collar 26 can be rotated about base member 18. When the lock nut is tightened, the respective collar 26 is effectively frictionally held to the base member, and is not readily rotated with respect to the base member. A layer of friction-controlling material (not shown) may be interposed between the collars 26 and base member 18, to modify the friction inherent between collars 26 and base support member 18.

Thus, tightening a lock nut 32 secures the respective collar 26 against rotation about base member 18 and simultaneously secures the respective support arm 24 against pivotation with respect to the lock stud 30.

Each upper support arm 24 includes a first inner arm segment secured to a second distal arm segment 36, in a telescoping arrangement, by a lock nut 38. Lock nut 38 provides for locking the length of the combination of the first and second segments 34, 36 at any length between a maximum length, with the distal segment fully extended with respect to the inner arm segment (e.g. FIG. 4), and a minimum length, with the distal segment fully retracted with respect to the inner arm segment (e.g. FIG. 8). Both segments 34 and 36 may be made with a variety of materials e.g. metal or plastic tubing.

Body locks 40 are mounted on the distal ends of distal arm segments 36. A body lock 40 includes a round lock button 42, locked into a lock slot 44 in a respective body bracket 46. The body brackets 46 are mounted to the central main body 2 of the floatation body of the water craft.

Figure 2:
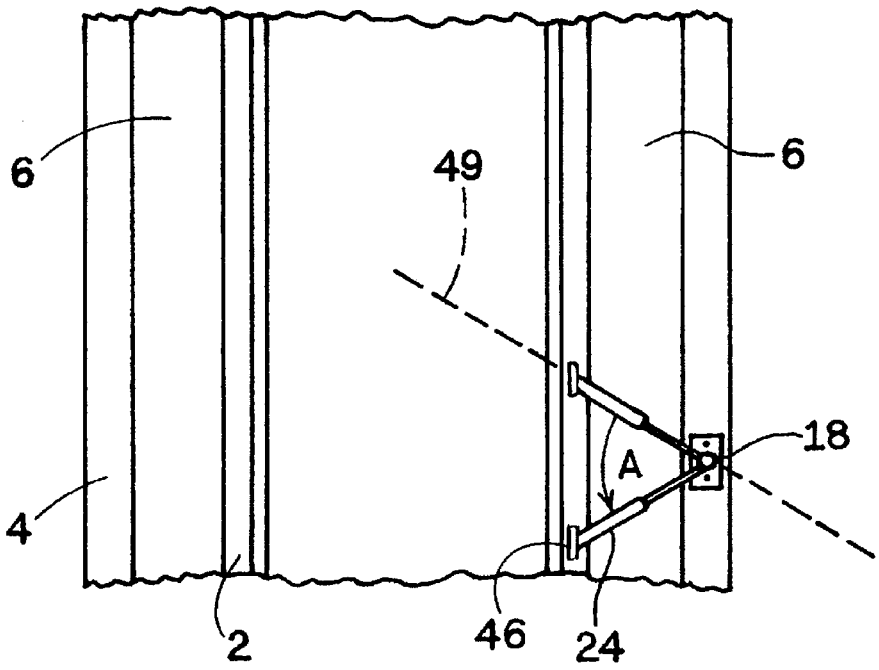
FIG. 2 shows a partial top view of the personal water craft of FIG. 1, taken at 2—2 of FIG. 1, illustrating the angle, and thus the lateral displacement, between the second and third support members.
Figure 3:
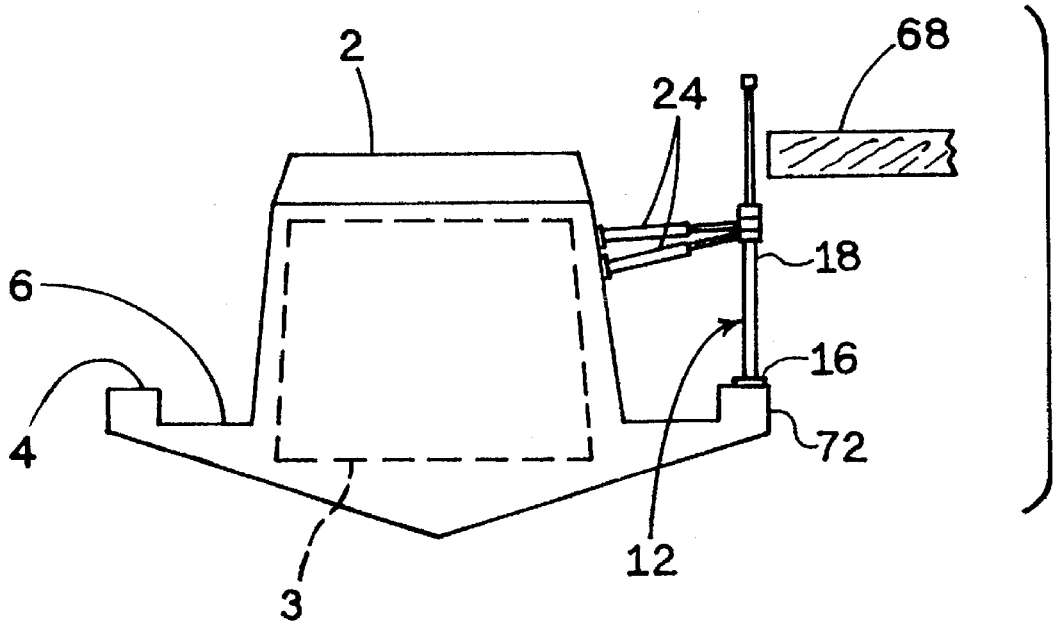
FIG. 3 shows a cross-section, taken at 3—3 of FIG. 1, illustrating the second and third support members providing lateral support to the upstanding base member extension with respect to a dock.

Referring now especially to FIGS. 2 and 3, the upper support arms 24 generally extend from near the top of the base member 18 laterally away from the base member, extending generally horizontally toward the main body 2, where they interface with the main body at body brackets 46. Further referring to FIG. 2, upper support arms 24 are laterally spread apart with respect to each other in order to provide angular stability to the standoff assembly 12. In general, one of the upper support arms 24 is contained in an imaginary plane 49, in common with base support member 18. The upper support arms are generally separated laterally by an angle "A" of at least about 30 degrees from plane 49. The angle "A" as shown in FIG. 2 is about 65 degrees, a range of about 60 to about 75 degrees being preferred. Upper support arms 24 may also be separated vertically. However, the vertical separation is typically rather limited, as illustrated in FIG. 3.

Figure 5:
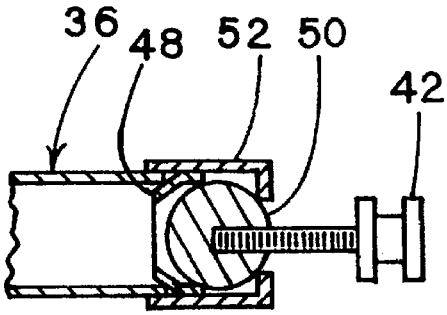
FIG. 5 shows an enlarged cross-section of the distal end of the second support member, and is taken at 5—5 of FIG. 4.

Referring now to FIG. 5, each distal segment 36 includes an insert 48, a ball 50, and a lock cap 52 mounting the ball 50 to insert 48, with screw threads (not shown) holding the lock cap 52 to the distal end of the segment 36. Thus, the ball 50 is frictionally held with restrained and restricted pivotation between insert 48 and lock cap 52 so long as lock cap 52 remains tightened against the ball 50. By loosening the lock cap 52 on the distal end of the segment 36, the lock button is released for free, three-way pivotation within the space defined between insert 48 and lock cap 52, and thus the lock button may be set at any convenient angle with respect to the body bracket 46.

with the body bracket 46 mounted on a given personal water craft, at the first mounting of the lock button 42 to the body bracket, the angle of the lock button 42 may be jet with respect to the distal segment 36, and locked in place by tightening lock cap 52. This holds the angle of the lock button at an angle convenient for repeated locking and unlocking of the lock button 42 into the respective body bracket. The lock cap 52 may be loosened at any time, thereby to facilitate resetting the angle of the lock button 42, which is then again locked in place by again tightening lock cap 52.

Figure 6:
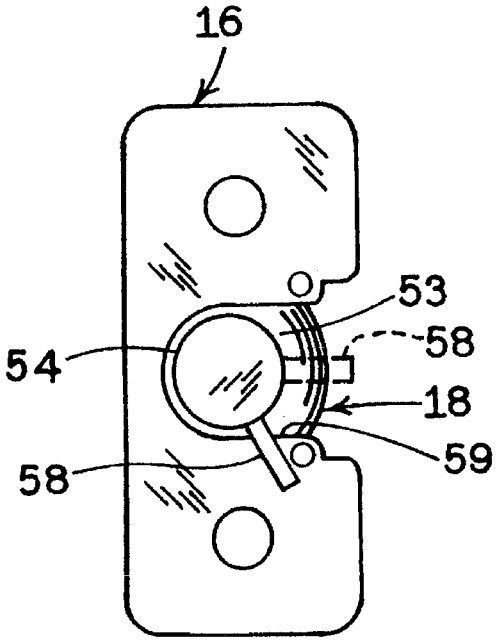
FIG. 6 shows a bottom view, taken at 6—6 of FIG. 1, of the lower end of the standoff assembly, with the leg locked under a receiving bracket at the gunwale of the personal water craft.

Referring now to FIGS. 4 and 6, the lower end 53 of base member 18 includes a leg 54 extending downwardly through receiving bracket 16, thereby bracket 16 provides a receptacle for receiving the leg at the gunwale 4. Bracket 16 may include a lower spacing plate (not shown), including a hole in such spacing plate for receiving the lower end of leg 54 at or above the top of the gunwale of the water craft. A lock stud 58, disposed under the top plate of receiving bracket 16, locks the base support member 18, and thus the entire standoff assembly 12, against vertical movement with respect to the personal water craft 1. Leg 54 is inserted into bracket 56 with lock stud 58 oriented into the opening 59, as shown in dashed outline in FIG. 6. After the lock stud 58 moves below the plane of the main lower surface of bracket 56, the base member 18, and typically the entire standoff assembly, is rotated about the vertical axis 61 of the base member 18, to bring the lock stud 58 below the bracket 56, such that the bracket prevents vertical movement of lock stud 58, as shown in FIG. 6.

Generally, collars 26 are tight about base member 18 when lock stud 58 is engaged under bracket 56. Upper support arms 24 are then engaged in body brackets 46. With the support arms 24 engaged in body brackets 46, and collars 26 tight about base member 18, the combination of support arms 24 and collars 26 prevents further rotation of the base member. With the base member 18 rotationally fixed in position, lock stud 58 is correspondingly prevented from rotating into the opening 59, and thus securely locked under bracket 58.

Figure 7:
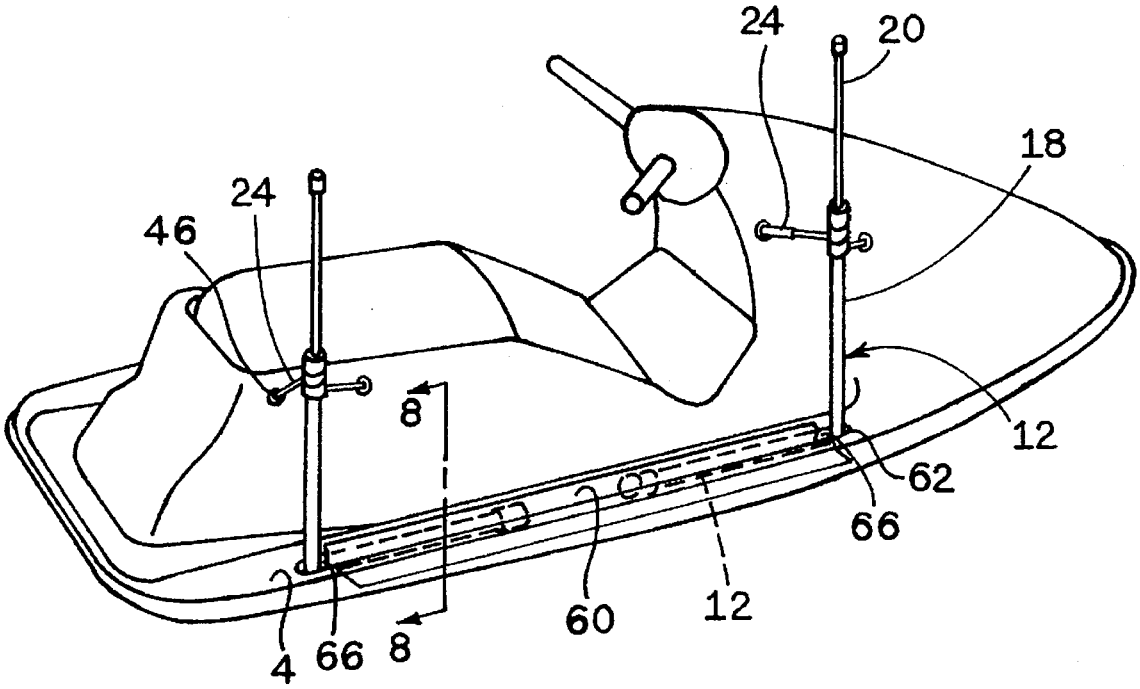
FIG. 7 shows a pictorial view of a personal water craft as in FIG. 1, including a storage compartment at the gunwale, for receiving a second embodiment of the standoff assembly of the invention.

FIGS. 7 and 8 illustrate a personal water craft 1 having a storage compartment 60 in the floatation body at gunwale 4, and a second embodiment of the standoff assembly which is more or less permanently mounted to the water craft. As illustrated in FIG. 8, the base member 18 is mounted in a receptacle 62 at the gunwale 4. Base member 18 pivots about pivot pins 64, from a vertical orientation, shown in FIGS. 7 and 8; to a horizontal orientation shown in dashed outline in FIG. 7. Receptacles 62 are in communication with compartment 60, through respective channels 66 connecting the receptacles 62 to the compartment 60. Thus, the respective standoff assemblies 12 can pivot; from the vertical orientation shown in FIGS. 7 and 8, to a horizontal orientation (dashed outline; FIG. 7), and thus be stored in compartment 60, while still mounted in the receptacle 62 by pivot pins 64. Accordingly, the standoff assemblies can be raised into a vertical or other upstanding orientation for use, and locked there by the extended support arms 24 being locked into body brackets 46, and can be lowered to e.g. horizontal orientation for storage in compartment 60, all while remaining securely attached to the water craft 1 through pivot pins 64.

Generally, when a standoff assembly 12 is raised into its upstanding orientation as shown in e.g. FIGS. 1, 3, and 7, the base member extension 20 is extended to the maximum length available for the combination of the base support member and the base member extension, as shown, to interface with a dock 68 or other relatively immobile object. The upper support arms 24 are extended as necessary to properly interface with the respective body brackets 46, which remain permanently mounted to the main body 2. When the standoff assembly is subsequently lowered to a horizontal or like orientation as shown in dashed outline in FIG. 7, or is otherwise prepared for storage, the base member extension 20 is typically retracted into the base support member 18, thus to reach the minimum length available for the combination of the base support member and the base member extension, as shown in FIG. 8. Also as shown in FIG. 8, for lowering and storage, the upper support arms are shortened by retracting the inner segments 34 into the distal segments 36.

Generally, the standoff assembly is mounted to the water craft with the base member extension 20, and the upper support arms retracted to their minimum lengths, illustrated in FIG. 8. As needed, lock nut 22 is loosened and the bas member extension 20 is raised to interface with a dock or the like, whereupon lock nut 22 is again tightened, to hold the base member extension 20 at the desired height. As illustrated in FIGS. 1, 3, 7, and 8, in the extended configuration, the upper end of base member extension 20 extends substantially above the gunwales, above lateral support arms 24, at least as high as the top of the central portion of the floatation body, preferably above the top of the floatation body, indeed above any other element of the water craft which might be damaged by impact with the dock.

While the description therein is directed to interfacing the water craft with a dock fixedly mounted as at the shoreline of a body of water, the standoff assembly of the invention is effective for interfacing the water craft with a variety of objects having a lesser degree of mobility than the water craft with respect to a personal water craft as illustrated therein, which is relatively small, and relatively light in weight, a wide variety of objects in or at the edge of a body of water may have a lesser degree of mobility—such as docks secured to the earth, floating docks, dive platforms, barges, conventional boats, and the like.

Support arms 24 may, of course, be mounted at other locations than against the main body. For example, one or more of the support arms can be mounted at or near foot rest 6, and still achieve the three spaced points of attachment necessary to give a rigid standoff assembly when all lock devices are tightened.

Further, support arms 24A, 24B can be combined or joined, as by a connecting arm (not shown) between them; or a single connecting arm 24 may be expanded, or expandable, to accommodate a suitable angle "A." In some embodiments, a single support arm, such as support arm 24A, may be used.

The base member 18 is preferably encased in a tightly fitted tube, made with resiliently deformable e.g. compressible foam, shown in dashed outline, and indicated at 80 in FIG. 4. A wide variety of preferably polymeric foam materials may be used for tube 80, including but not limited to ethylene vinyl acetates, polyethylenes, polypropylenes, urethanes, and the like. Where the tube 80 is comprised of a sufficiently light weight, closed cell foam floatation member of sufficient volume, the tube 80, in combination with the remaining elements of the standoff assembly, including the hollow tubes making up base member 18, base member extension 20, and support arms 24, provide sufficient floatation that the entire standoff assembly 12 floats in water, whereby the assembly 12 is easily retrieved if it is dropped in the water.

The standoff assembly 12 may further include a foam tube 82, shown in dashed outline, and indicated at 82, in FIG. 4 extending from the top of extension 20 down over lock nut 22, and preferably over collars 26, down to tube 80. A wide variety of materials may be used for foam tube 82, including the materials disclosed above for tube 80. Contrary to the preferred tight fit of tube 80, tube 82 preferably fits loosely over extension 20, whereby it can be easily installed and/or removed.

In general, foam tube 82 is removed from extension 20 before the extension 20 is retracted as in FIG. 8. When the extension 20 is extended, the foam tube 82 is installed. As shown in FIG. 4, the combination of tubes 80 and 82 provides a generally continuous cylindrical bumper surface for substantially the entire length of the standoff assembly. Thus, whatever the height of the dock 68 or other less mobile object, the actual point of contact between the dock and the standoff assembly 12 may be one or both of foam tubes 80, 82. Tubes 80, 82 could, of course, be combined into a single bumper tube.

It is contemplated that the operation and functions of the invention have become fully apparent from the foregoing description of elements, but for completeness of disclosure, the usage of the invention will be briefly described.

The standoff assembly of FIG. 4 is used as follows. The standoff assembly is generally to be received from the manufacturer, or from storage, with the base member extension 20 retracted into the base support member 18, and with the upper support arms retracted, both being as shown in FIG. 8. The standoff assembly is then mounted to the water craft at the lower end 53 of base member 18.

Referring to FIGS. 4 and 6, and with the receiving bracket 16 mounted to the respective gunwale 4, the leg 54 is inserted into the opening 59 in bracket 16, with the lock stud 58 oriented as shown in dashed outline in FIG. 6. As leg 54 is inserted into opening 59, lock stud 58 moves below the lower surface of the bracket 16. The entire standoff assembly is then rotated (See FIG. 6) to bring the lock stud 58 under the main plate of bracket 16, as shown in solid outline in FIG. 6. The leg 54 may be received by a locating depression, hole, or other structure in gunwale 4, as desired. In the alternative, bracket 16 may be spaced from an unmodified gunwale 4 in order to provide space for rotation of lock stud 58 under the bracket 16, with the lock stud in place as shown in solid outline in FIG. 6, any vertical movement of the standoff assembly is resisted by interference between the lock stud 58 and the bracket 16. Collars 26 and upper arms 24, in combination, prevent rotational movement of the standoff assembly.

With the standoff assembly thus mounted to the water craft at gunwale 4, the lock nuts 32 are loosened at the upper support arms 24. The upper support arms are then free to pivot with respect to the lock studs 30, and thereby to be moved into proper orientation with respect to corresponding body brackets 46 on the main body portion of the floatation body. Lock caps 52 are then loosened as needed, releasing lock buttons 42 to be oriented as desired with respect to the body brackets 46 and the respective support arms. The lock buttons are then inserted into the body brackets at lock slots 44, and locked in place.

With the lock buttons 42 thus locked in place on the main body 2, and with the leg 54 locked against vertical movement, the lock buttons are locked in place by tightening lock caps 52. Lock nuts 38 are also tightened, thus fixing the length of upper arms 24. In addition, lock nuts 32 are tightened, fixing the location of collars 26 on base support member 18, and preventing rotation of collars 26 about base member 18; and in addition preventing arms 24 from pivoting about lock studs 32. Finally, the lock nut 22 is loosened, the base member extension 20 is raised to the desired height for interfacing with the dock or other relatively immobile object, and lock nut 22 is again tightened.

Thus, by tightening lock caps 52, lock nut 38, lock nuts 32, and lock nut 22, after appropriate adjustments to the respective members so locked into desired positions and/or orientations, the standoff assembly is securely mounted on the water craft for which it was just adjusted. The so adjusted standoff assembly is thus sized and configured to the particular water craft, and thereby made into a rigid, but still adjustable, support accessory, able to efficiently serve as an interface for that water craft, to stand off the water craft from a dock or other relatively immobile object.

As illustrated in FIG. 3, when in use, the standoff assembly is mounted to the water craft at three loci, spaced both vertically and laterally, to give three spaced points of support between the standoff assembly and the water craft. In the preferred use, and as also illustrated in FIG. 3, two such standoff assemblies are used together on a common side of the water craft, one toward the bow and one toward the stern.

When the water craft is urged by wave action or like force toward the dock, the base members and/or base member extensions impact the dock, and transfer the impact, through the upper support arms 24, to the main body 2. Much of the impact is absorbed by base members 18, base member extensions 20 and upper support arms 24, whereby the main body is not damaged. With the base member extensions standing the water craft off from the dock, and with the water craft tied between legs or other upright members of the dock, the outer edges 72 of the water craft generally do not impact the dock, and are thereby spared any damage associated with such impact.

As used therein; including in the claims that follow, the phrase "outer edge" includes both outer upstanding sidewalls of the floatation body and the adjoining gunwales 4.

Figure 4A:
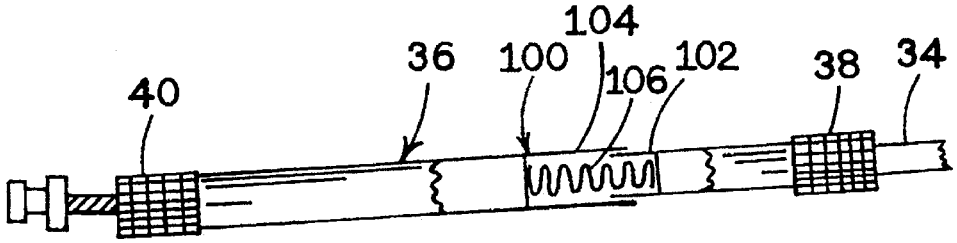
FIG. 4A shows a second embodiment of the distal arm segment.

Referring to FIG. 4A, distal arm segment 36 may include a resiliently compressible, or extensible, shock absorbing section 100. The shock absorbing section, as illustrated, includes an inner tubular member 102, an outer tubular member 104, and a spring 106 therebetween. Spring 106 resiliently dissipates lateral impact shock to the standoff assembly, in upper arms 24. Other impact absorbing mechanisms can be used in place of the specific shock absorbing section 100 shown. Further, shock absorbing section 100 can be employed on inner arm segment 34 in place of, or in addition to, its employment on distal arm segment 36.

When, if desired, the standoff assembly is to be removed from the water craft, the lock caps 52 are generally not loosened, but are left tightened. However, lock nuts 22, 32, and 38 are loosened. Base member extension 20 is retracted into base support member 18. Inner segments 34 are retracted into distal segments 36. Support arms 24 are pivoted about lock studs 30 into an alignment generally parallel to base member 18, as shown in FIG. 8. With the standoff assembly thus reduced in size, it is ready for storage in its compact form, in a limited amount of space, such as that illustrated in compartment 60.

Compartment 60 can be used with or without receptacles 62 and channels 66. Where compartment 60 is used without receptacles 62 and channels 66, the standoff assemblies 12 may be mounted to the gunwale as illustrated in FIGS. 1 and 6. The standoff assemblies are then completely dismounted from the gunwales before being stored in compartment 60.

Where receptacles 62 and channels 66 are used, the standoff assemblies are preferably left permanently, or semi-permanently mounted to the respective gunwale, and pivoted about pivot pins 64 for storage in compartment 60. However, the standoff assemblies must be readily removable from receptacles, and be readily mounted in corresponding receptacles at the gunwale on the left side of the water craft. Such removal may be, for example, by structure of the slots in which pivot pins 64 are mounted, by spring loading of pivot pins 64, or other known means for readily mounting and removing such mounting pins.

Figure 9:
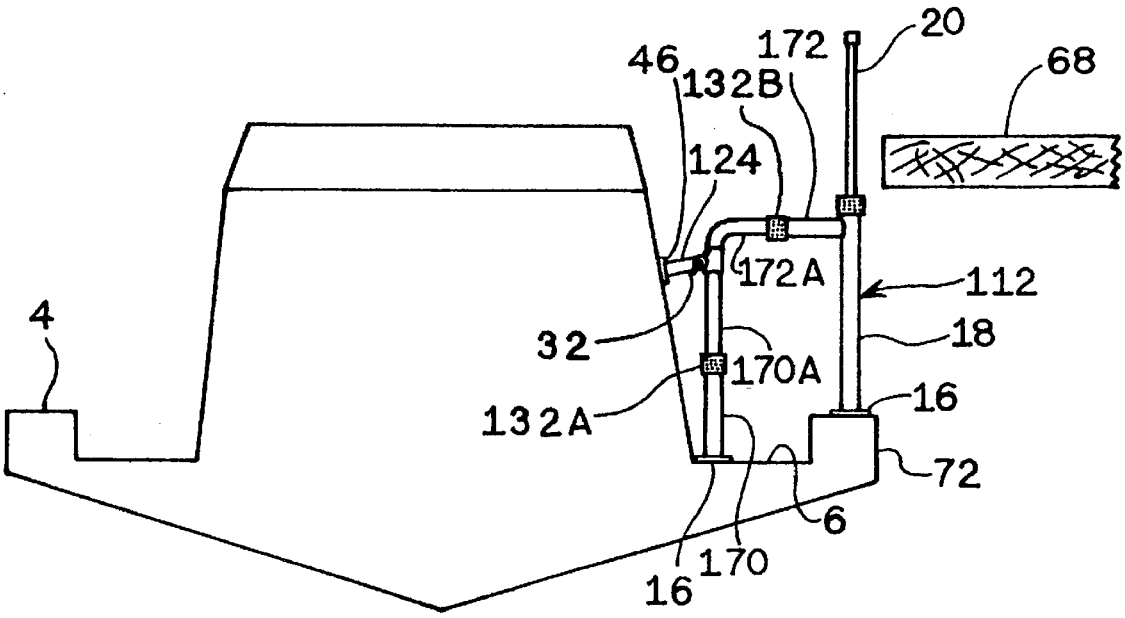
FIG. 9 is a cross section of a personal water craft as in FIG. 3, and illustrating a third embodiment of the standoff assembly of the invention.

A further embodiment of the standoff assembly is illustrated in FIG. 9 wherein standoff assembly 112 includes a generally U-shaped support member having a base member 18 as a first upstanding support leg, a second upstanding support leg 170, and a base member extension 20 received in the base member 18 as in the previous embodiment. The second support leg 170 is spaced from base member 18, extends downwardly generally parallel to the base member, and is mounted to the water craft, at the lower end of the leg 170, at foot rest 6. Transverse connecting leg 172 connects the first and second upstanding support legs 18 and 170 to each other. A third upper support arm 124 is mounted, by a lock nut 32, for pivotation about a lock stud 30, and with respect to the upper end of the second upstanding support leg 170. Lock nuts 132A and 132B allow for extension and retraction of respective extensible segments 170A and 172A of the respective legs 170 and 172, to adjust the height of leg 170 and the length of transverse leg 172.

As seen in the several drawings, the standoff assemblies of the invention are particularly suited for use with small water craft such as the line of products known as personal water craft, and generally designed as illustrated therein. Such water craft sit low in the water, such that ordinary devices for protecting water craft from docks ad the like, which are designed to hang down from the outer edge of the water craft, are wholly ineffective for protecting personal water craft. Rather, the standoff devices of the invention extend upwardly from the outer edge of the water craft, and interface with the dock at a location above at least the lower locus of attachment to the water craft. Thus, when the water craft is urged against the dock, the base member extension 20 interfaces with, and thus bumps, the dock, instead of the water craft bumping the dock. Depending on the particular application, either the base member 18 or the base member extension 20 interface with the dock or other less mobile object, preferably through one or both of foam tubes 80, 82, depending on the height of the dock or other less mobile object above the water.

Those skilled in the art will now see that certain modifications can be made to the apparatus and methods therein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A boat bumper, for attachment to a water craft propinquant an outer perimeter of the water craft, and for interfacing with objects which are relatively less mobile, relative to the mobility of the water craft, said boat bumper comprising:

(a) a first base support member, having a lower end, including securing apparatus at said lower end for mechanically securing said boat bumper to the water craft at a first lower locus;

(b) a base member extension extending upwardly from said first base support member to an upper end, for interfacing with the relatively less mobile object above said first base support member; and (c) a second upper support member mounted to one of said base support member and said base member extension above said lower end and below said upper end, and extending laterally from said first base support member and interfacing with the water craft at a second locus above the lower end.

2. A boat bumper as in claim 1, said second support member being mounted for pivotation with respect to said one of said base support member and said base member extension, thereby to pivot into an orientation parallel to said base support member.

3. A boat bumper as in claim 1, said base support member comprising mechanical lock apparatus for locking said lower end of said base support member to the water craft at the first lower locus.

4. A boat bumper as in claim 1, said base member extension extending upwardly along an axis, said lower end of said base support member comprising a reduced diameter leg extending downwardly along the axis.

5. A boat bumper as in claim 4, including a locking stud extending through said base support member transverse to the axis, for locking said leg, and respectively said first base support member, against vertical movement with respect to the water craft.

6. A boat bumper as in claim 5, said second upper support member being secured against rotation with respect to said first base support member such that securement of said second upper support member to the water craft after said locking stud is locked against vertical movement with respect to the water craft, prevents rotation of said base support member about the axis, thus preventing corresponding rotation of said locking stud about the axis.

7. A boat bumper as in claim 1, said base support member and said base member extension comprising respective first and second elongated elements, for extending the combination of said base member extension and said base support member to a first extended length for use, and retracting the combination of said base member extension and said first base support member to a second retracted length for storage, and a locking device, for locking said first and second elongated elements relative to each other at lengths at and between the first and second lengths.

8. A boat bumper as in claim 1, said second upper support member including first and second elongated segments, for extending said second support member to a first extended length for use, and for retracting said second support member to a second retracted length for storage, and a locking device, for locking said first and second segments relative to each other along a range of lengths of said second support member.

9. A boat bumper as in claim 1, said second upper support member including a resilient shock absorbing section.

10. A boat bumper as in claim 1, said second support member including locking apparatus for locking said second support member to the water craft at the second locus.

11. A boat bumper as in claim 10, said locking apparatus on said second support member comprising a lock button, in combination with a body bracket for securement to the water craft, said body bracket, when secured to the water craft, being adapted to receive said lock button and thereby to lock said second support member to the water craft, through said body bracket.

12. A boat bumper as in claim 11, said lock button being mounted to said second support member for restrained pivotation with respect to said second support member.

13. A boat bumper as in claim 1, including a floatation member secured to said boat bumper, said floatation member having sufficient floatation lift to, in combination with the remaining elements of said boat bumper, cause said boat bumper to float in water.

14. A boat bumper as in claim 1, said boat bumper having a length, said boat bumper comprising at least one resiliently deformable bumper member extending along the length of said boat bumper.

15. A boat bumper, for attachment to a water craft propinquant an outer perimeter of the water craft and for interfacing with objects which are relatively less mobile, relative to the mobility of the water craft, said boat bumper comprising:

(a) a first base support member, having a lower end, including securing apparatus at said lower end for mechanically securing said boat bumper to the water craft at a first lower locus;

(b) a base member extension extending upwardly from said first base support member, for interfacing with the relatively less mobile object above said first base support member;

(c) a second upper support member mounted to one of said base member extension and said first base support member, for securement to the water craft at a second locus at least as high as the lower locus; and (d) a third support member, secured to one of said base member extension and said first base support member, said third support member being adapted to be secured to the water craft at a third locus above said lower end of said first base support member, the combination of said first, second and third support members providing at least three points of support between said boat bumper and the water craft, with at least one of the at least three points of support being higher than at least one other of the at least three points of support.

16. A boat bumper as in claim 15, said second support member comprising a second upper support member, mounted to one of said base member extension and said first base support member, for securement to the water craft at a second locus above the lower end.

17. A boat bumper as in claim 15, said second and third support members being mounted to at least one of said base member extension and said first base support member, for pivotation with respect to said first base support member, thereby to pivot into an orientation extending alongside said first base support member.

18. A boat bumper as in claim 16, said second upper support member, when extended away from said first base support member thereby to interface with a water craft, defining, in combination with said first base support member, an imaginary plane, said third support member, when extended away from said first base support member, thereby to interface with a water craft, defining an angle of at least about 30 degrees with respect to the imaginary plane.

19. A boat bumper as in claim 15, said first base support member comprising lock apparatus for mechanically locking said lower end of said first base support member to the water craft at the first locus.

20. A boat bumper as in claim 15, said base member extension extending upwardly along an axis, said lower end comprising a reduced diameter leg extending downwardly along the axis, for insertion into a receptacle at the first locus, and for thereby being secured to the water craft at the first lower locus.

21. A boat bumper as in claim 20, said lower end of said base support member being mounted at the first lower locus for rotation about the axis while said base member extension is in an upstanding orientation, and a locking stud extending transversely from said leg, for locking said leg, and respectively said first base support member, against vertical movement with respect to the water craft.

22. A boat bumper as in claim 15, said second and third support members being secured against rotation about said first base support member such that securement of said second and third support members to the water craft after said locking stud is locked against vertical movement, prevents rotation of said base support member about the axis, thus preventing corresponding rotation of said locking stud about the axis.

23. A boat bumper as in claim 15, said first base support member and said base member extension, in combination, including respective first and second elongated elements, for extending the combination of said base member extension and said first base support member to a first extended length for use, and retracting the combination of said base member extension and said first base support member to a second retracted length for storage, and a locking device, for locking said first and second elongated elements relative to each other at lengths at and between the first and second lengths.

24. A boat bumper as in claim 15, said second and third support members each including first and second elongated segments, for extending the respective said support members to first extended lengths for use, and for retracting the respective said support members to second retracted lengths for storage, and a locking device, locking the respective said first and second segments relative to each other along a range of lengths of the respective said ones of said second and third support members.

25. A boat bumper as in claim 24, at least one of said second and third upper support members including a resilient shock absorbing section therein.

26. A boat bumper as in claim 15, said second support member including locking apparatus for locking said second support member to the water craft at the second locus.

27. A boat bumper as in claim 26, said locking apparatus on said second support member comprising a lock button, in combination with a body bracket for securement to the water craft, said body bracket, when secured to the water craft, being adapted to receive said lock button and thereby to lock said second support member to the water craft, through said body bracket.

28. A boat bumper as in claim 27, said lock button being mounted to said second support member for restrained pivotation with respect to said second support member.

29. A boat bumper as in claim 15, including a floatation member secured to said boat bumper, said floatation member having sufficient floatation lift to, in combination with the remaining elements of said boat bumper, cause said boat bumper to float in water.

30. A boat bumper as in claim 15, said boat bumper having a length, said boat bumper including a bumper, comprising at least one resiliently deformable bumper member extending along the length of said boat bumper.

31. A boat bumper as in claim 15, each of said second and third support members having a length defined between a first end, secured to one of said base member extension and said first base support member, and a second distal end, for securement to the water craft, at least one of said second and third support members being mounted to extend the distal end thereof laterally away from the first base support member to thereby be secured to the water craft at a respective said locus, laterally displaced from said lower end.

32. A boat bumper as in claim 31, both of said second and third support members being mounted to extend the respective distal ends thereof laterally away from the first base support member, and laterally away from each other at an angle of at least about 30 degrees, to thereby be secured to the water craft at the second and third loci, laterally displaced from said lower end, and laterally displaced from each other.

33. A boat bumper as in claim 31, said second support member including locking apparatus at said distal end thereof, for locking said second support member to the water craft, said locking apparatus comprising a lock button mounted for restrained pivotation with respect to said second support member.

34. A boat bumper as in claim 15, said first and second support members being secured to the water craft at respective first and second lower loci, said third support member being secured in said boat bummer standoff above said lower end of said first base support member, for securement to the water craft at a third locus above said lower end.

35. A boat bumper as in claim 34, said third support member extending laterally from said second support member for securement to the water craft at the third locus, the third locus being displaced both vertically and laterally from said lower end of said first base support member.

36. A boat bumper, for attachment to a water craft, the water craft having opposing first and second outer edges at opposing first and second gunwales thereof, first and second foot rests disposed inwardly of, and below, the respective gunwales, and a centrally disposed main body between, and extending upwardly from, the foot rests, said boat bumper comprising a generally U-shaped support member having (i) first and second spaced support legs, upstanding when said boat bumper is mounted on the personal water craft, said first and second support legs having respective first and second lower ends, said first leg having an upstanding base member extension for interfacing with a relatively immobile object, relative to the mobility of the personal water craft, (ii) first and second lock devices at the respective said first and second lower ends, for locking said boat bumper to the personal water craft at a first locus at the first outer edge of the water craft, and at a respective second locus disposed inwardly of the water craft from the first locus, (iii) a transverse connecting leg extending from said first upstanding support leg inwardly of said water craft, to said second upstanding support leg, and connecting said first and second upstanding support legs to each other, and (iv) a third support leg mounted in said boat bumper above said first and second lock devices, and providing lateral support in alignment with an imaginary surface extending between said first and second support legs.

37. A boat bumper as in claim 36, said third lock device providing lateral support in said boat bumper above said first and second lock devices.

38. A water craft, comprising:

(a) a floatation body including a raised central portion thereof having a top and first and second gunwales disposed substantially below the top of the central portion and propinquant the typical waterline of said water craft;

(b) drive apparatus mounted in said personal water craft; and (c) a boat bumper mounted in said personal water craft, said boat bumper comprising a first base support member, having a lower end secured to said floatation body at a first lower locus adjacent one of said first and second gunwales, a base member extension extending upwardly from said first base support member to an upper end, for interfacing with an object which is relatively immobile, relative to the mobility of said water craft, above said first base support member, and a second upper support member, mounted to one of said first base support member and said base member extension above the lower end and below said upper end, said second upper support member extending laterally from said first base support member and being secured to said floatation body at a second locus above the lower end.

39. A water craft, comprising:

(a) a floatation body including a raised central portion thereof having a top, and first and second gunwales disposed substantially below the top of the central portion and propinquant the typical waterline of said water craft;

(b) drive apparatus mounted in said personal water craft; and (c) a boat bumper mounted in said water craft, said boat bumper comprising a first base support member, having a lower end, including securing apparatus at said lower end mechanically securing said boat bumper to said floatation body at a first lower locus adjacent one of said first and second gunwales, a base member extension extending upwardly from said first base support member to an upper end, for interfacing with an object which is relatively immobile, relative to the mobility of said personal water craft, above said first base support member, a second support member, mounted to one of said base member extension and said first base support member, and secured to said floatation body at a second locus, and a third support member, mounted to one of said base member extension, and said first base support member, said third support member being secured to said floatation body at a third locus above the lower end, the combination of said first, second and third support members providing at least three points of support between said boat bumper and the water craft, with at least one of the at least three points of support being higher than at least one other of the at least three points of support.

40. A water craft as in claim 39, said second support member comprising a second upper support member, mounted to one of said base member extension and said first base support member above the lower locus, interfacing with the water craft at the second locus above the lower end.

41. A water craft as in claim 39, said third support member being mounted to one of said base member extension and said first base support member above the lower locus and below said upper end, and interfacing with said floatation body at the third locus, above the lower end.

42. A water craft as in claim 39, said second and third support members each being mounted to at least one of said base member extension and said first base support member for pivotation with respect to said first base support member, thereby to pivot into an orientation parallel to said first base support member.

43. A water craft as in claim 40, said second upper support member, when extended away from said first base support member thereby to interface with said floatation body, defining, in combination with said first base support member, an imaginary plane, said third support member being mounted to one of said base member extension and said first base support member, and when extended away from said first base support member thereby to interface with said floatation body, defining an angle of at least about 30 degrees with respect to the imaginary plane.

44. A water craft as in claim 39, said base support member comprising mechanical lock apparatus mechanically locking said lower end of said base support member to said floatation body at the first locus.

45. A water craft as in claim 39, said base member extension extending upwardly along an axis, said lower end of said base support member comprising a leg extending downwardly along the axis, said floatation body comprising a receptacle, receiving said leg at the lower locus.

46. A water craft as in claim 45, said leg being mounted for rotation about the axis while said first base support member is in an upstanding orientation, and a locking stud extending transversely from said leg, locking said leg, and respectively said first base support member, against vertical movement with respect to said floatation body.

47. A water craft as in claim 46, said second and third support members being secured against rotation about said first base support member such that securement of said second and third support members to the water craft after said locking stud is locked against vertical movement, prevents rotation of said base support member about the axis, thus preventing corresponding rotation of said locking stud about the axis.

48. A water craft as in claim 39, said first base support member and said base member extension, in combination, including respective first and second elongated elements, for extending the combination of said base member extension and said first base support member to a first extended length for use, and retracting the combination of said base member extension and said first base support member to a second retracted length for storage, and a locking device, for locking said first and second elongated elements relative to each other at lengths at and between the first and second lengths.

49. A water craft as in claim 39, said second and third support members each including first and second elongated segments, for extending the respective said support members to first extended lengths for use, and for retracting the respective said support members to second retracted lengths for storage, and a locking device, for locking the respective said first and second segments relative to each other along a range of lengths of the respective said ones of said second and third support members.

50. A water craft as in claim 49, at least one of said second and third support members including a resilient shock absorbing section.

51. A water craft as in claim 39, said second support member including locking apparatus for locking said second support member to the floatation body at the second locus.

52. A water craft as in claim 51, said locking apparatus on said second support member comprising a lock button, in combination with a body bracket mounted on said floatation body, said body bracket being adapted to receive said lock button and thereby to lock said second support member to said floatation body, through said body bracket.

53. A water craft as in claim 52, said lock button being mounted to said second support member for restrained pivotation with respect to said second support member.

54. A water craft as in claim 39, said third support member being secured to one of said base member extension and said first base support member above the lower locus and below the upper end, and secured to said floatation body above the lower locus.

55. A water craft as in claim 39, including a floatation member secured to said boat bumper, said floatation member having sufficient floatation lift to, in combination with the remaining elements of said boat bumper, cause said boat bumper to float in water.

56. A water craft as in claim 39, said boat bumper having a length, said boat bumper comprising at least one resiliently deformable bumper member extending along the length thereof.

57. A water craft as in claim 39, said second support member extending away from said first base support member and being secured to said floatation body, and thereby defining, in combination with said first base support member, an imaginary plane, said third support member extending away from said first base support member and being secured to said floatation body, and thereby defining an angle of at least about 30 degrees with respect to the imaginary plane.

58. A water craft as in claim 39, said second support member and said floatation body, in combination, including locking apparatus securing said second support member to said raised central portion of said floatation body at the second locus.

59. A water craft as in claim 51, said locking apparatus on said second support member comprising a lock button, in combination with a body bracket mounted on said floatation body, for receiving said lock button and locking said second support member to said floatation body, through said body bracket.

60. A water craft as in claim 51, said locking apparatus including a lock button mounted to said second support member for restrained pivotation with respect to said second support member.

61. A water craft as in claim 39, said personal water craft including a storage compartment adjacent said lower end of said first base support member, and a receptacle receiving said lower end of said base support member, said storage compartment being in communication with said receptacle to receive said boat bumper within said storage compartment while said boat bumper is secured to said floatation body at said lower end.

62. A water craft as in claim 61, said storage compartment being comprised in said floatation body, said boat bumper being mounted for pivotation with respect to the water craft at said lower end, thereby to pivot into a substantially horizontal orientation for storage of said boat bumper in said storage compartment, and to pivot into an upstanding orientation for standoff use, all while said boat bumper is secured to said floatation body at said lower end.

63. A water craft as in claim 39, each of said second and third support members having a length defined between a respective first end, mounted to one of said base member extension and said first base support member, and a respective second distal end secured to the floatation body, at least one of said second and third support members being mounted for extension of the distal end thereof laterally away from the first base support member to thereby be secured to the floatation body at the second locus, laterally displaced from the first base support member.

64. A water craft as in claim 63, both of said second and third support members being mounted to extend the respective distal ends thereof laterally away from the first base support member, and laterally away from each other at an angle of at least 30 degrees, to thereby be secured to the floatation body at the second and third loci, laterally displaced from said lower end, and laterally displaced from each other.

65. A water craft as in claim 63, said second support member including locking apparatus at said distal end thereof, for locking said second support member to said floatation body, said locking apparatus comprising a lock button mounted for restrained pivotation with respect to said second support member.

66. A water craft, comprising:

(a) a floatation body, including opposing first and second outer edges at opposing first and second gunwales thereof, first and second foot rests disposed inwardly of, and below, the respective said gunwales, and a centrally disposed main body between, and extending upwardly from, said foot rests;

(b) drive apparatus mounted in said personal water craft; and (c) a standoff assembly mounted to said water craft at said first gunwale for pivotation of said standoff assembly, with respect to said water craft, said standoff assembly being effective to interface with an object above said gunwale when said standoff assembly is oriented in an upstanding orientation.

67. A water craft as in claim 66, including a receptacle, a gunwale storage compartment at said first gunwale, and a channel extending from said receptacle and communicating with said storage compartment, the combination of said receptacle, said channel, and said storage compartment being effective to facilitate pivoting the standoff assembly between the upstanding orientation for use, and a horizontal orientation for storage in said storage compartment.

68. A method of protecting a floating water craft, having a first degree of mobility in the water, from being damaged by a force urging the water craft against a second object having a second lesser degree of mobility in the water, the second object having a first height above the water, the water craft having opposing first and second outer edges on opposing first and second sides thereof the first and second outer edges having a second height below the first height, the method comprising the steps of:

(a) positioning the water craft sufficiently close to the second object that the second object poses a hazard to the water craft;

(b) securing a standoff assembly to the water craft propinquant the first outer edge of the water craft at substantially the second height; and (c) extending the standoff assembly upwardly from the first outer edge of the water craft at substantially the second height to at least the first height, and interfacing the standoff assembly in its upwardly extending orientation with the second object at the first height, and thereby standing the water craft off from the second object and preventing the water craft from being impacted against and damaged by, the second object.

69. A method as in claim 68, the standoff assembly comprising a first standoff assembly mounted to the water craft at the first locus, on the first side of the water craft, and including extending a second such standoff assembly, similarly secured to the water craft at a fourth locus along the first outer edge, displaced from the first locus, to at least the first height, thereby to stand the water craft off from the second object at the first and fourth loci, along the first outer edge, thus preventing the water craft from pivoting about the first standoff assembly and impacting the first side against the second object at a fifth locus displaced from the first locus.

70. A method of protecting a floating water craft, having a first degree of mobility in the water, from being damaged by a force urging the water craft against a second object having a second lesser degree of mobility in the water, the second object having a first height above the water, the personal water craft having opposing first and second outer edges on opposing first and second sides thereof, the first and second outer edges having a second height below the first height, the method comprising the steps of:

(a) positioning the personal water craft sufficiently close to the second object that the second object poses a hazard to the personal water craft;

(b) securing a standoff assembly to the water craft propinquant the first outer edge of the water craft at substantially the second height; and (c) extending the standoff assembly upwardly from the first outer edge of the water craft at substantially the second height to at least the first height, the standoff assembly being secured to the water craft at lower and upper spaced loci of securement, the spaced securements fixing the orientation of the standoff assembly with respect to the water craft, the first locus of securement being spaced vertically from the second locus of securement the standoff assembly interfacing with the second object above the second height, and thereby standing the water craft off from the second object and preventing the water craft from being impacted against, and damaged by, the second object.

71. A method as in claim 70, the standoff assembly comprising a first standoff assembly mounted to the personal water craft at the first locus, on the first side of the personal water craft, and including extending a second such standoff assembly, similarly secured to the personal water craft at a fourth locus along the first outer edge, displaced from the first locus, from the first outer edge of the water craft at substantially the second height to at least the first height, thereby to stand the water craft off from the second object at the first and fourth loci, along the first outer edge, thus preventing the water craft from pivoting about the first standoff assembly and impacting the first side against the second object at a fifth locus displaced from the first locus.

72. A water craft, comprising:

(a) a floatation body including a raised central portion thereof having a top, and first and second gunwales disposed substantially below the top of the central portion and propinquant a waterline of said water craft;

(b) drive apparatus mounted in said personal water craft; and (c) a boat bumper mounted to said flotation body, said boat bumper comprising a generally U-shaped support member having (i) first and second spaced upstanding support legs, said first and second support legs having respective first and second lower ends, mounted to said floatation body, (ii) a transverse connecting leg connecting said first and second upstanding support legs to each other above said lower ends, (iii) a third support leg mounted in said boat bumper above said lower ends, and interfacing with said raised central portion of said floatation body, to thereby provide lateral support to said boat bumper.

73. A water craft as in claim 72, said boat bumper further comprising an upstanding extension member extending upwardly from said first leg, for interfacing with a relatively immobile object.

74. A water craft, comprising:

(a) a floatation body including a raised central portion thereof having a top, and first and second gunwales disposed substantially below the top of the central portion and propinquant the typical waterline of said water craft;

(b) drive apparatus mounted in said personal water craft; and (c) a boat bumper mounted to said flotation body, said boat bumper having (i) an upstanding support leg having a lower end mounted to said floatation body at a first lower locus adjacent one of said first and second gunwales, (ii) a lateral support leg mounted in said boat bumper above said lower end, and interfacing with said raised central portion of said floatation body, to thereby provide lateral support from said raised central portion to said boat bumper, said upstanding support leg extending upwardly to an upper end thereof at least as high as said raised central portion of said floatation body, to thereby protect substantially the full height of said floatation body from impact with a relatively less mobile object.

75. A water craft as in claim 74, said upper end of said upstanding support leg extending above all other elements of said water craft.

76. A water craft as in claim 74, said boat bumper further including a second lateral support leg mounted in said boat bumper above said lower end and interfacing with said raised central portion of said floatation body, said second support leg defining, in combination with said base support member, an imaginary plane, said second lateral support leg defining an angle of at least about 30 degrees with respect to the imaginary plane.

* * * * *